United States Patent [19]

Hartiala et al.

[11] Patent Number: 4,711,090

[45] Date of Patent: Dec. 8, 1987

[54] METHOD OF AND DEVICE FOR ADJUSTING THE FEED MOVEMENT OF A DRILL ROD FOR DRILLING A ROCK

[75] Inventors: Eero Hartiala, Kangasala; Jaakko Kuusento, Tampere; Hannu Paasonen, Nokia, all of Finland

[73] Assignee: Oy Tampella Ab, Tampere, Finland

[21] Appl. No.: 41,644

[22] Filed: Apr. 22, 1987

Related U.S. Application Data

[63] Continuation of Ser. No. 617,624, Jun. 6, 1984, abandoned.

[30] Foreign Application Priority Data

Jun. 14, 1983 [FI] Finland ..... 832145

[51] Int. Cl.[4] ..... F16D 31/02

[52] U.S. Cl. ..... 60/422; 60/427; 91/520; 91/530; 173/8; 173/9

[58] Field of Search ..... 91/520, 530; 60/422, 60/427; 173/8, 9

[56] References Cited

U.S. PATENT DOCUMENTS

| | | | |
|---|---|---|---|
| 3,303,753 | 2/1967 | McCay, Jr. | 91/520 |
| 3,802,514 | 4/1974 | Ein et al. | 173/8 |
| 4,061,201 | 12/1977 | Dunn | 60/422 |
| 4,215,622 | 8/1980 | Chichester | 91/530 |
| 4,485,623 | 12/1984 | Chichester et al. | 60/422 |
| 4,516,467 | 5/1985 | Keeney et al. | 91/516 |
| 4,526,085 | 7/1985 | Morizur et al. | 91/530 |

FOREIGN PATENT DOCUMENTS 56722 11/1979 Finland .

*Primary Examiner*—A. Michael Chambers
*Attorney, Agent, or Firm*—Ladas & Parry

[57] ABSTRACT

In a method of and device for adjusting the feed movement of a drill rod for drilling a rock, the drill rod is rotated by a pressure-medium-operated rotary motor and fed in a drilling direction and in the opposite direction by a pressure-medium-operated feed motor. A pressure change on the pressure side of the rotary motor due to a change in the rotation resistance on the rotary motor acts oppositely on the pressure and outlet sides of the feed motor toward reversing the feed force of the feed motor, i.e. in inverse and direct dependence on the pressure change, respectively. The pressures on the pressure side and the outlet side of the feed motor are, therefore, controlled so that, when the pressure on one side increases because of the pressure change, the pressure on the other side decreases and vice versa.

9 Claims, 9 Drawing Figures

Figure 1:
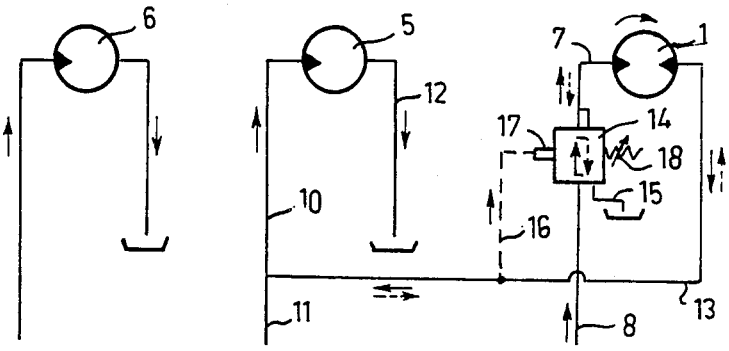

METHOD OF AND DEVICE FOR ADJUSTING THE FEED MOVEMENT OF A DRILL ROD FOR DRILLING A ROCK

This is a continuation of co-pending application Ser. No. 617,624 filed on June 6, 1984, now abandoned.

The present invention relates to a method of and device for adjusting the feed movement of a drill rod for drilling a rock, the drill rod being rotated by a pressure-medium-operated rotary motor, and the feed movement being in a drilling direction and in the opposite direction by means of a pressure-medium-operated feeder, i.e. feed motor, a pressure change on a pressure side of the rotary motor due to a change in the rotation resistance on the rotary motor acting oppositely on a pressure and an outlet side of the feeder in a way toward reversing the feed force of the feeder, i.e. in inverse and direct dependence on the pressure change, respectively.

In this context, the pressure side or port of the feeder means the side or port of the feeder having higher pressure medium relative to the outlet side or port having lower pressure medium, during a normal drilling situation of the feeder, i.e. when the feeder is feeding the drill rod in the drilling direction, i.e. towards the rock.

When drilling in rock having cracks and crushed zones, there is a danger of the drill rod becoming wedged by the feed force and a percussion. It is then important that the feed force acting on the drill rod is decreased or reversed to act in the opposite direction depending on the magnitude of the rotary resistance of the drill rod.

An attempt to solve the problem caused by a wedging of the drill rod has been made in Finnish Pat. No. 56,722 in such a way that the increase of pressure on the pressure side of the rotary motor, caused by the increased rotary resistance because of cracks and crushed zones in the rock, directly affects the outlet-port pressure of the feed motor. Such an arrangement decreases the feed force of the feed motor and thus the feed movement of the drill rod and, if the pressure on the pressure side of the rotary motor increases to become higher than the pressure on the pressure side of the feed motor, the feed direction of the feed motor is reversed.

The drawback with this arrangement, especially in smaller drilling units, is that when this sensitivity of feed control of the feed motor to a change of the rotary pressure is made sufficient, the feed motor must be substantially oversized. This is uneconomical, and it also causes inconvenient delays in the operation.

Another device is known from earlier Finnish Pat. No. 55,893 for decreasing the feed force when the rotary resistance is increasing. In this device, a bleeder valve is mounted in the pressure line of the feed motor, which valve rapidly connects the pressure line to a low pressure when the rotary resistance is increasing. The valve is brought in operation due to a change of the pressure in either one of the pressure ports of the rotary motor.

This arrangement has the drawback that the operation is instantaneous and discontinuous, whereby the feed motor of the drilling unit performs a sawing, i.e. hunting and thus strenuous motion. Furthermore, a certain counter pressure must be maintained on the outlet side of the feed motor in order to ensure that the direction of the feed movement is changed when the valve allows the pressure of the pressure port to change to a low pressure.

The object of this invention is to provide a method which avoids the above drawbacks. This object is achieved with the method according to the invention, which is characterized in that the pressures on both the pressure side and the outlet side of the feeder are controlled so that, when the pressure on one side increases because of said rotary-drill-motor pressure change, the pressure on the other side of the feeder, i.e. feed motor, decreases and vice versa.

The invention is based on the idea that the feed force of the feeder is affected by continuously adjusting the pressure in both pressure ports of the feeder so that, when the pressure in one pressure port increases because of a change of the rotary resistance of the rotary device (motor and drill rod), the pressure in the other pressure port decreases, and vice versa when the rotary resistance returns to normal. In this manner the feed force of the feeder can be influenced when the rotary resistance increases, not only by increasing the counter pressure on the outlet side of the feeder due to the increased pressure of the rotary motor, but also by decreasing the operating pressure on the inlet side of the feeder in a corresponding degree. Such an arrangement enables an even and continuous control of the feed force in dependence of the rotary resistance.

The invention also relates to a device for applying the above-described method. With such a device the advantages of the method according to the invention can be realized by simple means and couplings.

Figure 4:
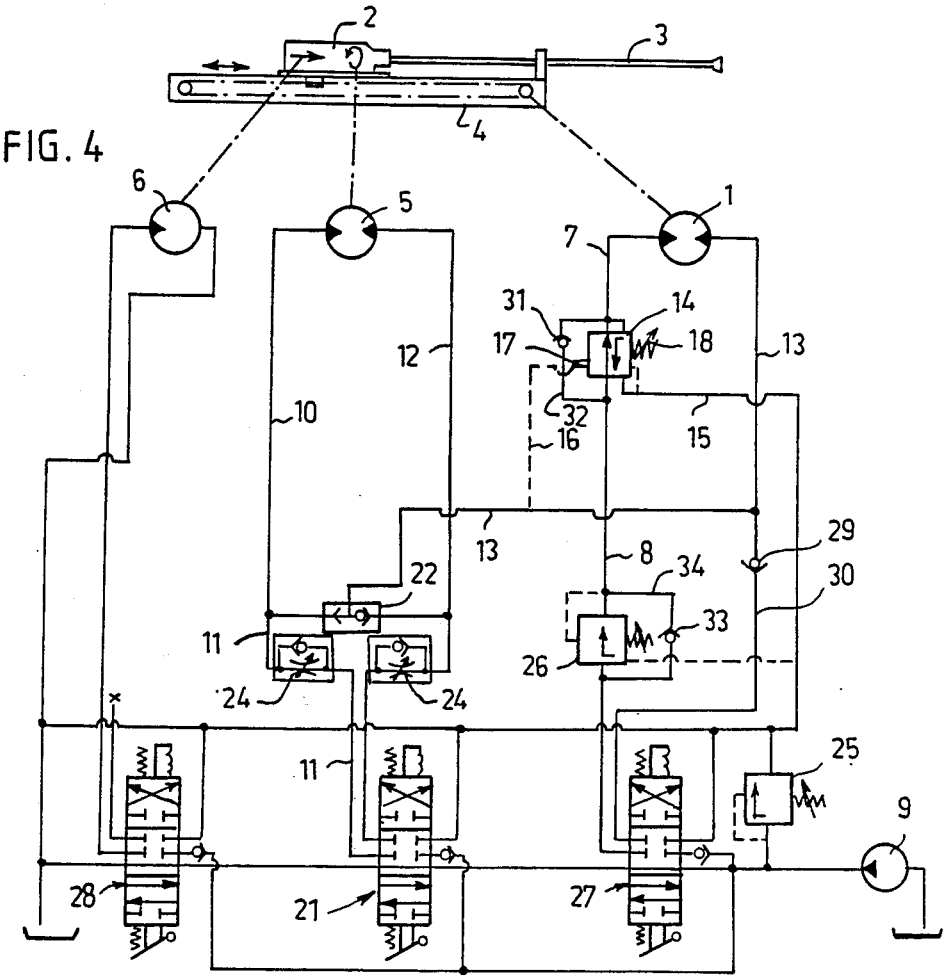
Figure 2:
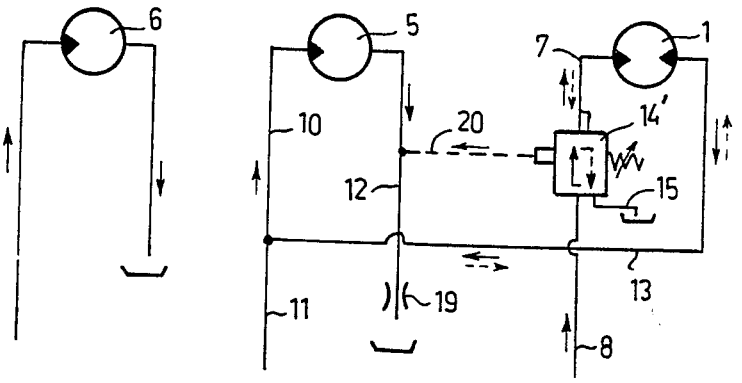
Figure 3:
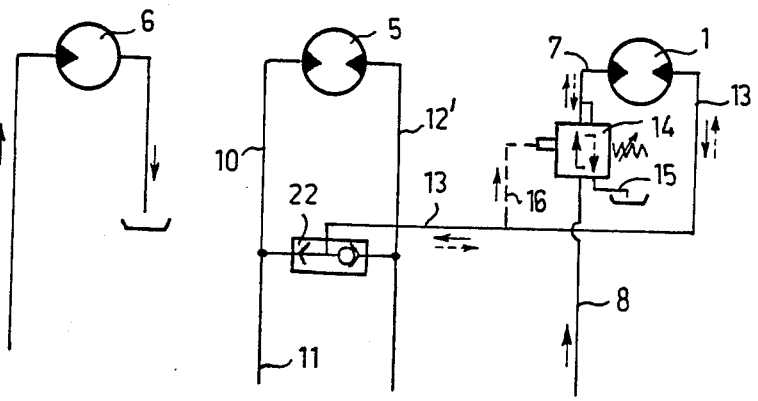
Figure 5:
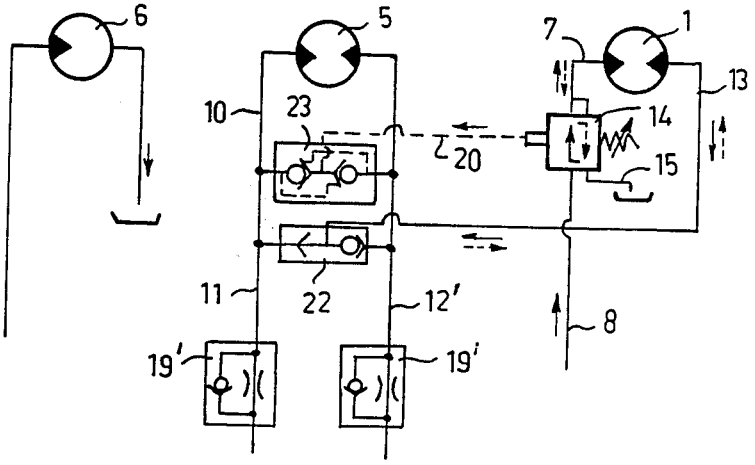
Figure 6:
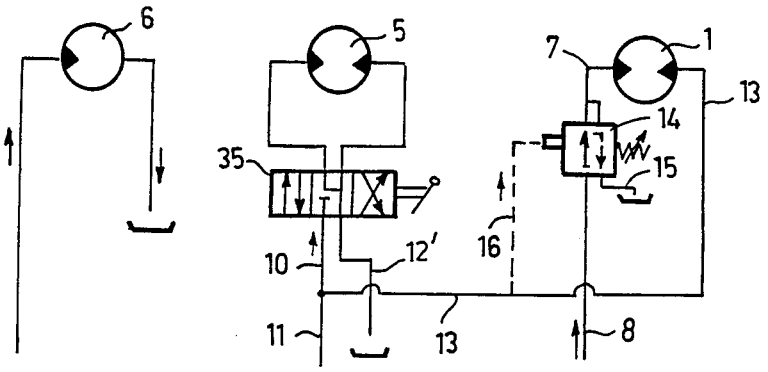
Figure 7:
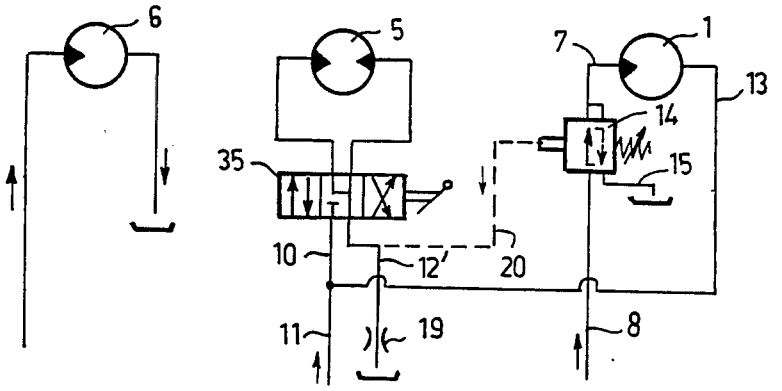

The invention is described in more detail in the following with reference to the enclosed drawings, wherein FIG. 1 is a schematical view of a first embodiment of a device according to the invention, FIG. 2 is a schematical view of a second embodiment of the device, FIGS. 3 and 6 show two other embodiments of devices similar to FIG. 1, but adapted for reversible operation of a rotary motor, FIG. 4 shows a coupling circuit for a drilling unit provided with the device according to FIG. 3, FIGS. 4A and 4B respectively show the coupling circuit according to FIG. 4 in a normal drilling situation and a crush drilling situation, and FIGS. 5 and 7 show two other embodiments of devices similar to FIG. 2, but adapted for reversible operation of the rotary motor.

The device shown in FIGS. 1 and 4 comprises a pressure medium operated feed motor 1 for moving a drill rod 3 fastened to a drilling machine 2 of a drilling unit along a feed bar 4 towards the material to be drilled (not shown), i.e. in the drilling direction, and correspondingly for drawing the drill rod away from the material to be drilled, i.e. in the return direction. The drilling unit furthermore comprises a pressure medium operated rotary motor 5 for rotating the drill rod. Especially when drilling in hard materials, a pressure medium operated percussion element 6 for directing axial percussions on the drill rod is also a part of the drilling unit. The percussion element is, however, not described in more detail in the following because its operation does not affect the operation of the device according to the invention.

The feed motor is connected by pipes 7 and 8 to a pressure medium pump 9, FIG. 4, and the pressure side of the rotary motor is connected by pipes 10 and 11 to said pump. The outlet side of the rotary motor is connected by a pipe 12 to a container. The feed motor is connected by the pipe 13 to a pipe 10 on the pressure side of the rotary motor.

The pressure medium supplied to the feed motor 1 is normally adjusted to a certain pressure which is optimized for a certain undisturbed drilling situation. Hereby the difference between the pressures in the pipes 7 and 13 corresponds to the desired feed force.

The pressure medium supplied to the rotary motor 5 is normally adjusted to a certain amount per time unit which is optimized for a certain undisturbed drilling situation. The amount of medium flowing in the pipe 10 is the sum of the medium amounts flowing from the pipes 13 and 11 which flow amount corresponds to the desired rotation speed.

A pressure regulating valve 14 is connected to the pipe 7 of the feed motor which valve in one extreme position connects the pipe 8 to the pipe 7 of the feed motor and in the other extreme position closes said connection and connects the pipe 7 through the pipe 15 to the container. The valve is controlled by the pipe 13 of the feed motor through the pipe 16.

FIG. 4 illustrates a coupling circuit for a drilling unit which is provided with a device according to FIG. 3 which corresponds to the device according to FIG. 1 adapted for a reversible operation of the rotary motor.

The feed motor is connected by the pipes 7 and 8 to the pump 9 through valves 14, 26 and 27. Because it is desirable that the drill rod 3 can be drawn out from the hole also by manual control, e.g. when the hole is ready, the pipe 13 of the feed motor is connected to valve 27, which is; a flow direction control valve, by means of a pipe 30 through a non-return valve 29. In this stage of withdrawal of the drill, the pipes 7 and 8 operate as a return line and in order to enable the return flow of the medium, the pressure regulating valve 14 is bypassed by means of a pipe 32 through a non-return valve 31. The pressure regulating valve 26 is also bypassed by means of a pipe 34 through a non-return valve 33. The control valve 27 thus allows feed motor a control in both directions.

The rotary motor 5 is connected by the pipes 10 and 11 to the pump 9 through one of two flow control valves 24 and a flow direction control valve 21 and also by the pipe 12 through the other flow control valve 24 to said control valve 21. The control valve 21 allows a control in both directions.

The pipe 13 of the feed motor which in a normal drilling situation operates as the return pipe of the feed motor is connected by means of a shuttle valve 22 always to that pressure line of the rotary motor in which the pressure is higher depending on the rotation direction chosen by means of the valve 21.

The pressure regulating valve 14 connected to the pipe 7 of the feed motor connects the pipe 8 to the pipe 7 of the feed motor always when the pressure force acting on the operating device 17 of the valve 14 is smaller than the adjustment of the regulating device 18 of the valve.

The percussion element 6 is here connected to the same pump 9 by means of a flow direction control valve 28.

The maximum pressure in the circuit is limited by a valve 25.

The optimal pressure on the pressure side of the feed motor and consequently also the biggest feed force is adjusted by means of the pressure regulating valve 26 connected to the pipe 8 in an undisturbed drilling situation, whereby the feed motor presses the drill rod 3 of the drill 2 towards the material to be drilled in this drilling situation.

The coupling circuit for a drilling unit shown in FIG. 4 is in other respects and as to its details of conventional construction and is therefore not described more exactly.

Figure 4A:
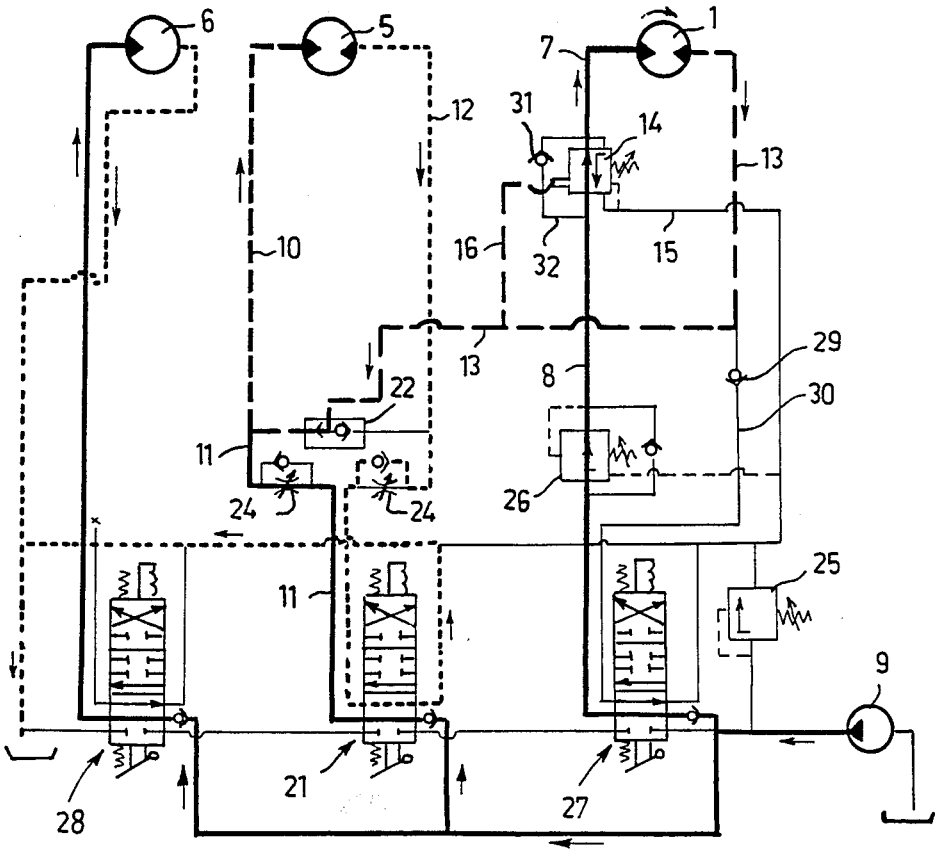

In a normal drilling situation, FIG. 4A, the pressure medium pump feeds medium to the feed motor 1 through the valves 27 and 26, the pipe 8, the valve 14 and the pipe 7. The pressure medium flows through the feed motor and rotates it in such a direction that the drill rod moves in the drilling direction. Because the feed motor takes energy from the medium, the pressure of the medium leaving the feed motor is lower in the pipe 13 on the outlet side than in the pipe 7 on the inlet side.

Figure 4B:
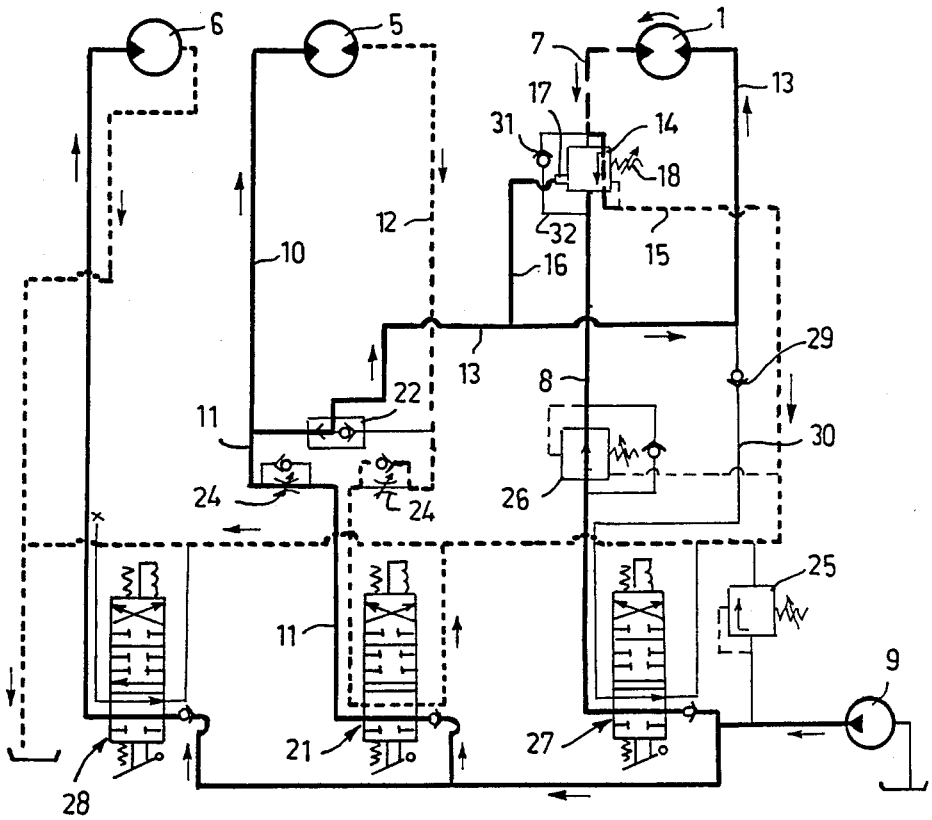

In FIGS. 4A and 4B the high pressure medium is shown with thick continuous lines, the lower pressure medium with thick broken lines and the lowest pressure medium with thick dotted lines.

The lower pressure medium flows through the pipe 13 of the feed motor to the pipe 10 on the pressure side of the rotary motor 5. Because the rotary motor requires energy considerably, it is furthermore suitable to allow an amount of medium regulated by the valve 24 to flow from the pump to the pipe 11, which amount joins the medium flowing from the pipe 13. The medium rotates the rotary motor which rotates the drill rod during drilling. Thus the desired rotation speed of the drill rod is regulated by the valve 24. Simultaneously the percussion element 6 directs successive percussions on the drill rod.

Consequently, in a drilling situation the pipes 10, 11, 13 and 15 have a higher pressure than the pipe 12, whereby the pressure difference corresponds to the rotation resistance of the drill rod. The pipe 7 also has a higher pressure than the pipe 13, whereby the pressure difference corresponds to the feed force by which the feed motor 1 presses the drill rod towards the rock. Furthermore, the pressure in the pipe 7 is as high as or lower than the pressure in the pipe 8 and therefore the pressure in the pipe 8 determines the maximum speed of the feed force. In practice, however, the operating device 17 of the valve 14, e.g. the surface area affecting the valve spindle and the position of the regulating device 18 of the valve, is chosen so that, in a normal drilling situation, the pressure in the pipe 7 is as high as or only slightly lower than the pressure in the pipe 8.

FIG. 4B illustrates a crush drilling situation. When the drill rod hits a crack or a crushed zone in the rock, the rotation resistance of the drill rod increases. Because of this the pressure in the pipe 10 on the pressure side of the rotary motor 5 and thus also in the pipes 11, 13 and 16 increases. Hence a higher pressure acts on the outlet side of the feed motor 1 than in a normal drilling situation. An increase of the pressure in the control pipe 16 of the valve 14 results in that the spindle of the control valve starts to increasingly choke the medium flow from the pipe 8 to the pipe 7 on the pressure side of the feed motor, whereby the pressure in the pipe 7 and in the pressure port of the feed motor decreases. Therefore, because, on one hand, the pressure in the pipe 13 on the outlet side of the feed motor has increased and, on the other hand, the pressure in the pipe 7 on the inlet side has decreased, the desired decrease of the feed force caused by the feed motor has been achieved, so that the wedging of the drill rod can be prevented.

The pressure regulating valve 14 including its operating device 17 and regulating device 18, which e.g. may be a spring, can be made such that, if the rotation despite the above mentioned action still increases, the valve finally completely closes the flow from the pipe 8 to the pipe 7 and opens the connection from the pipe 7 to the low pressure in the pipe 15, as shown in FIG. 4B. Hereby the pressure in the pipe 13 of the feed motor has become higher than in the pipe 7, whereby the flow of pressure medium through the feed motor and its rotation direction are reversed and the feed motor draws the drill rod away from the crushed material.

In the alternative device shown in FIG. 2 the same reference numerals have been used for corresponding parts as in FIG. 1. A throttle valve 19 is provided in the outlet pipe 12 of the rotary motor and the control for a valve 14' is obtained from the pipe 12 through a pipe 20 at a point between the motor and the throttle valve.

When the rotary motor rotates, the medium flowing in the outlet pipe 12 causes a pressure loss over the throttle valve. When the rotation resistance is small and the flow of liquid is big, the pressure acting over the throttle valve maintains the valve 14' open through the pipe 20 so that pressure medium can flow through the valve and the pipes 8, 7 to the feed motor 1 and onwards to the rotary motor 5 through the pipes 13, 10, whereby the operation is normal.

When the rotation resistance increases, the medium flow in the pipe 12 decreases and thus the pressure loss over the throttle valve 19 decreases correspondingly. The pressure decrease controls the valve 14' through the pipe 20 so that, when the rotation resistance increases sufficiently and the pressure decreases sufficiently in the pipe 20, the valve reverses the medium flow through the feed motor and thus changes the drilling movement of the drill rod into a return movement in the same manner as described in connection with FIG. 1.

FIG. 3 illustrates a device similar to that in FIG. 1 for such a situation in which a rotation in two directions is desirable and the rotary motor is rotatable in different directions. Either of the medium pipes 10, 11 or 12' of the rotary motor can be alternatively connected to the pump to act a pressure conduit and another pipe to the container to act as an outlet conduit. The flow direction control valve 21 included in the circuit shown in FIG. 4 is provided with a possibility to reverse the direction of rotation.

In order to connect the pipe 13 from the feed motor to the pipe acting in each case as a pressure pipe, a shuttle valve 22 is mounted between the pipes 10 and 12', whereby the circuit operates in principle in the manner according to FIG. 1.

FIG. 5 illustrates a device similar to that of FIG. 2, which allows a reversal of the rotation of the rotary motor.

A valve 23 is mounted between the pipes 10 and 12'. The control pipe 20 of the pressure regulating valve 14 is always connected through this valve to the pipe having in each case the lowest pressure, whereby the operation in each rotation direction is the same as in FIG. 2. The throttling in two directions on the return side is obtained by mounting one-way restricting valves 19' in the pipes 11 and 12'.

FIG. 6 illustrates the device according to FIG. 1 provided with a reversible operation of the rotary motor. A flow direction control valve 35 is connected to the pipes 10 and 12' of the rotary motor. The valve enables a change of the pressure ports of the rotary motor and thus a change of the rotation direction. Otherwise the operation is fully in accordance with FIG. 1.

FIG. 7 illustrates the device according to FIG. 2 provided with a reversible operation of the rotary motor. A flow direction control valve 35 is connected to the pipes 10 and 12' of the rotary motor, which valve enables a change of the pressure ports of the rotary motor and thus a change of the rotation direction. Otherwise the operation is fully in accordance with FIG. 2.

The drawings and the description relating thereto are intended only to illustrate the idea of the invention. In its details the method and the device according to the invention may vary within the scope of the claims. Instead of a feed motor also a pressure medium cylinder or a similar displacing means can be used as a feeder.

What is claimed is:

1. A device for adjusting feed movement of a drill rod for drilling rock, comprising:

a pressure-medium-operating rotary motor (5) for rotating a drill rod, the rotary motor having a pressure side (10) for a pressure medium, the pressure of the pressure medium at the pressure side (10) changing in response to a change in rotation resistance on the rotary motor;

a pressure-medium-operated feed motor (1) for feeding the drill rod in a drilling direction and a opposite direction of feed movement, the feed motor having a pressure side (7) and an outlet side (13) for the pressure medium for the feed motor (1) to respond to a higher pressure of the pressure medium at the pressure side (7) thereof relative to a lower pressure of the pressure medium at the outlet side (13) thereof with feed movement of the drill rod in the drilling direction and, vice versa, the opposite direction; and pressure-medium connection means for supplying the pressure medium to the pressure sides (10,7) of the rotary and feed motors (5,1), connecting the pressure side (10) of the rotary motor (5) to the outlet side (13) of the feed motor (1), and (14,16; 14,20) acting the pressure change of the pressure medium of the pressure side (10) of the rotary motor (5) oppositely on the pressure medium of the pressure and outlet sides (7,13) of the feed motor (1) in inverse and direct dependence on the pressure change, respectively.

2. The device of claim 1, wherein the rotary motor further comprises an outlet side (12) and the pressure medium connection means (14,16; 14,20) for acting the pressure change comprises a pressure-regulating valve (14) means for supplying the pressure medium to the pressure side (7) of the feed motor (1) and response means (16,20) for the pressure-regulating valve (14) to respond to the pressure of the pressure medium of at least one of the sides (10,12) of the rotary motor.

3. A device according to claim 2, wherein the pressure regulating valve is provided with a control connection to the pressure side of the rotary motor so that, when the pressure increases on the pressure side of the rotary motor, the valve throttles a connection of the feed motor to a conduit connected to a pressure medium source.

4. A device according to claim 3, wherein the pressure regulating valve is mounted in a conduit between a container and the pressure side of the feed motor so that the valve opens a connection from the pressure side to said conduit in substantially the same proportion as the valve throttles said connection of the feeder to said conduit connected to the pressure medium source.

5. A device according to claim 3, wherein the rotary motor is reversible and each of its sides is alternatively connectable to the pressure medium source, said outlet side of the feed motor is connected to both sides of the rotary motor by means of a shuttle valve which opens a connection to that side which in each case operates as the pressure side of the rotary motor.

6. A device according to claim 2, wherein the pressure regulating valve is provided with a control connection to the outlet side of the rotary motor so that, when the pressure decreases on the outlet side of the rotary motor, the valve throttles a connection of the feed motor to a conduit connected to a pressure medium source.

7. A device according to claim 6, wherein a flow throttle valve is provided on the outlet side of the rotary motor between a container and said control connection of the pressure regulating valve.

8. A device according to claim 6, wherein said control connection of the pressure regulating valve is connected to both sides of the rotary motor by means of a pressure-controlled shuttle valve which opens a connection to that side which in each case operates as the outlet side of the rotary motor.

9. A method of adjusting feed movement of a drill rod for drilling rocks, comprising:

rotating a drill rod with a pressure-medium-operated rotary motor having a pressure side for a pressure medium, the pressure of the pressure medium at the pressure side the rotary motor changing in response to a change in rotation resistance on the rotary motor;

feeding the drill rod in a drilling direction and an opposite direction of feed movement with a pressure-medium-operated feed motor having a pressure side and an outlet side for a pressure medium, the feed motor responding to higher pressure of the pressure medium at the pressure side thereof relative to lower pressure of the pressure medium at the outlet side thereof by feeding the drill rod in the drilling direction and, vice versa, the opposite direction;

sensing the pressure change of the pressure medium of the pressure side of the rotary motor; and adjusting the pressure of the pressure medium of the pressure side of the feed motor in inverse dependence on the pressure change.

* * * * *